US006420102B1

(12) United States Patent
Bauer et al.

(10) Patent No.: US 6,420,102 B1
(45) Date of Patent: Jul. 16, 2002

(54) THERMALLY DEVELOPABLE IMAGING MATERIALS CONTAINING HYDROXY-CONTAINING POLYMERIC BARRIER LAYER

(75) Inventors: Charles L. Bauer, Webster; Michelle L. Horch, Rochester; Anne M. Miller, Batavia; David M. Teegarden, Pittsford, all of NY (US); Bryan V. Hunt, Fridley; Kumars Sakizadeh, Woodbury, both of MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/916,366

(22) Filed: Jul. 27, 2001

(51) Int. Cl.[7] ..... G03C 1/498; G03C 1/76

(52) U.S. Cl. ..... 430/350; 430/264; 430/523; 430/531; 430/533; 430/619; 430/620; 430/961; 430/964; 430/935; 430/965

(58) Field of Search ..... 430/350, 531, 430/533, 523, 619, 620, 264, 607, 961, 964, 935, 965

(56) References Cited

U.S. PATENT DOCUMENTS

| | | | | |
|---|---|---|---|---|
| 4,460,681 A | * | 7/1984 | Frenchik | 430/502 |
| 6,352,819 B1 | * | 3/2002 | Kenny et al. | 430/353 |
| 6,352,820 B1 | * | 3/2002 | Bauer et al. | 430/353 |

* cited by examiner

*Primary Examiner*—Thorl Chea
(74) *Attorney, Agent, or Firm*—J. Lanny Tucker; Louis M. Leichter

(57) ABSTRACT

Thermographic and photothermographic materials comprise a barrier layer to provide physical protection and to prevent migration of diffusible imaging components and by-products resulting from high temperature imaging and/or development. The barrier layer comprises a film-forming acrylic or methacrylic acid ester or amide polymer(s) that has a molecular weight of at least 8000 g/mole and comprises hydroxy functionality in from about 15 to 100 mole % of the acrylic or methacrylic acid ester or amide recurring units. This barrier layer is capable of retarding diffusion of mobile chemicals such as fatty carboxylic acids, developers, and toners. This barrier layer can also include at least one other film-forming polymer to provide a clear and scratch-resistant surface.

38 Claims, No Drawings

THERMALLY DEVELOPABLE IMAGING MATERIALS CONTAINING HYDROXY-CONTAINING POLYMERIC BARRIER LAYER

FIELD OF THE INVENTION

This invention relates to thermally developable imaging materials such as thermographic and photothermographic materials. More particularly, it relates to thermographic and photothermographic imaging materials having improved physical protection by the presence of a unique barrier layer. The invention also relates to methods of imaging using these materials. This invention is directed to the photothermographic and thermographic imaging industries.

BACKGROUND OF THE INVENTION

Silver containing thermographic and photothermographic imaging materials that are developed with heat and without liquid development have been known in the art for many years.

Thermography or thermal imaging is a recording process wherein images are generated by the use of thermal energy. In direct thermography, a visible image is formed by imagewise heating a recording material containing matter that changes color or optical density upon heating. Thermographic materials generally comprise a support having coated thereon: (a) a relatively or completely non-photosensitive source of reducible silver ions, (b) a reducing composition (usually including a developer) for the reducible silver ions, and (c) a hydrophilic or hydrophobic binder.

Thermographic recording materials become photothermographic upon incorporating a photosensitive catalyst such as silver halide. Upon imagewise exposure to irradiation energy (ultraviolet, visible or IR radiation) the exposed silver halide grains form a latent image. Application of thermal energy causes the latent image of exposed silver halide grains to act as a catalyst for the development of the non-photosensitive source of reducible silver to form a visible image. These photothermographic materials are also known as "dry silver" materials.

In such materials, the photosensitive catalyst is generally a photo-graphic type photosensitive silver halide that is considered to be in catalytic proximity to the non-photosensitive source of reducible silver ions. Catalytic proximity requires an intimate physical association of these two components either prior to or during the thermal image development process so that when silver atoms, $(Ag^0)_n$, also known as silver specks, clusters, nuclei, or latent image are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials* (*Neblette's Eighth Edition*), Sturge, Walworth & Shepp (Eds.), Van Nostrand-Reinhold, New York, Chapter 9, pp. 279–291, 1989]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, zinc oxide, and cadmium sulfide have also been reported as useful in place of silver halide as the photocatalyst in photothermographic materials [see, for example, Shepard, J. *Appl. Photog. Eng.* 1982, 8(5), 210–212, Shigeo et al., *Nippon Kagaku Kaishi*, 1994, 11, 992–997, and FR 2,254,047 (Robillard)].

The photosensitive silver halide may be made "in situ, " for example by mixing an organic or inorganic halide-containing source with a source of reducible silver ions to achieve partial metathesis and thus causing the in-situ formation of silver halide (AgX) grains on the surface of the silver source [see for example, U.S. Pat. No. 3,457,075 (Morgan et al.)]. In addition, photosensitive silver halides and sources of reducible silver ions can be coprecipitated [see Usanov et al., *J. Imag. Sci. Tech.* 1996, 40, 104]. Alternatively, a portion of the reducible silver ions can be completely converted to silver halide, and that portion can be added back to the source of reducible silver ions (see Usanov et al., International Conference of Imaging Science, Sep. 7–11, 1998).

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and photothermographic material. The preformed silver halide grains may be introduced prior to and be present during the formation of the source of reducible silver ions. Co-precipitation of the silver halide and source of reducible silver ions provides a more intimate mixture of the two materials [see for example, U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids." Salts of other organic acids or other organic compounds, such as silver imidazolates, silver benzotriazoles, silver tetrazoles, silver benzotetrazoles, silver benzothiazoles and silver acetylides have been proposed. U.S. Pat. No. 4,260,677 (Winslow et al.) discloses the use of complexes of various non-photosensitive inorganic or organic silver salts.

In photothermographic materials, exposure of the photosensitive silver halide to light produces small clusters of silver atoms, $(Ag^o)_n$. The imagewise distribution of these clusters known in the art as a latent image, is generally not visible by ordinary means. Thus, the photosensitive emulsion must be further developed to produce a visible image. This is accomplished by the reduction of silver ions that are in catalytic proximity to silver halide grains bearing the silver-containing-clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the non-photosensitive reducible silver ions, often referred to as a "developer," may be any compound that in the presence of the latent image, can reduce silver ions to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. Upon heating, this reduction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing using aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus imaged, the photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

Moreover, in photothermographic materials, all of the "chemistry" for imaging is incorporated within the material itself. For example, such materials include a developer (that is, a reducing agent for the reducible silver ions) while conventional photographic materials usually do not. Even in so-called "instant photography", the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is, in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they pose different considerations and present distinctly different problems in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al (Eds.), The Focal Press, London and New York, 1978, pp. 74–75, and in Zou, Sahyun, Levy and Serpone, *J. Imaging Sci. Technol.* 1996, 40, pp. 94–103.

Problem to be Solved

As noted above, thermographic and photothermographic materials generally include a source of reducible silver ions for thermal development. The most common sources of reducible silver ions are the silver fatty acid carboxylates described above. Other components in such materials include a reducing agent system that usually includes a reducing agent, and optionally a toning agent in photothermographic materials (common ones being phthalazine and derivatives thereof) in one or more binders (usually hydrophobic binders). These components are generally formulated for coating using polar organic solvents.

We have found that by-products including various fatty carboxylic acids (such as behenic acid) are formed in the materials during thermal development. These fatty acid by-products as well as the reducing agent and any toner that is present can readily diffuse out of the materials during thermal development and cause debris build-up on the thermal processing equipment (such as processor drums). This may result in the processed materials sticking to the processing equipment and causing a jam in the machine, as well as scratching of the outer surface of the developed materials.

It is known from U.S. Pat. No. 5,422,234 (Bauer et al.) and U.S. Pat. No. 5,989,796 (Moon) to use a surface overcoat layer in photothermographic materials to minimize the problems noted above. This overcoat layer comprises gelatin, poly(vinyl alcohol), poly(silicic acid), or combinations of such hydrophilic materials. While these overcoat layer materials provide suitable barriers to diffusion of reagents from the photothermographic materials, they are typically coated from water. Coating a separate hydrophilic layer from water when the imaging layer(s) are generally coated from polar organic solvents is not desirable for a number of reasons.

While polyacrylates and cellulosic materials can also be used as barrier layer materials to provide physical protection, they do not adequately prohibit diffusion of all by-products of thermal development out of the thermographic and photothermographic materials.

Useful water-soluble barrier layer polymers including water-soluble polyesters, as described in copending U.S.

Ser. No. 09/728,416, filed Dec. 1, 2000 by Kenney, Skoug, Ishida, and Wallace, as useful in thermally-developable materials.

Additional useful film-forming barrier layer polymers are those having epoxy functionality as described in copending U.S. Ser. No. 09/729,256, filed Dec. 1, 2000 by Miller, Horch, Bauer, and Teegarden.

Still additional polyesters useful as barrier layers are described in copending U.S. Ser. No. 09/821,983 filed Mar. 30, 2001 by Bauer, Horch, Miller, Yacobucci, and Ishida.

There remains a need for thermally developable materials that have additional suitable barrier layers that provide physical protection while inhibiting the diffusion of various chemicals out of the materials during thermal development. It would be particularly desirable to have improved thermographic and photothermographic materials that include a layer that acts as a barrier to the diffusion of fatty acids from the materials during thermal development and that can be coated from polar organic solvents.

SUMMARY OF THE INVENTION

The problems noted above are solved with a thermally developable material comprising a support having thereon:

a) one or more thermally developable imaging layers comprising a binder and in reactive association, a non-photosensitive source of reducible silver ions and a reducing composition for the non-photosensitive source of reducible silver ions, and b) a barrier layer that is on the same side of but farther from the support than the one or more imaging layers, the barrier layer comprising a film-forming acrylic or methacrylic acid ester or amide polymer having a molecular weight of at least 8000 g/mole and comprising recurring units derived from one or more ethylenically unsaturated polymerizable acrylic or methacrylic acid ester or amide monomers, wherein from about 15 to 100 mole % of the recurring units in the polymer are derived from such monomers that have hydroxy functionality.

This invention also provides a black-and-white photothermographic material comprising a support having thereon:

a) one or more thermally developable imaging layers comprising a binder and in reactive association, a photocatalyst, a non-photo-sensitive source of reducible silver ions, and a reducing composition for the non-photosensitive source of reducible silver ions, and b) a barrier layer that is on the same side of but farther from the support than the one or more imaging layers, the barrier layer comprising a film-forming acrylic or methacrylic acid ester or amide polymer having a molecular weight of at least 8000 g/mole and comprising recurring units derived from one or more ethylenically unsaturated polymerizable acrylic or methacrylic acid ester or amide monomers, wherein from about 15 to 100 mole % of the recurring units in the polymer are derived from such monomers that have hydroxy functionality.

Further, a method of this invention for forming a visible image comprises:

A) imagewise exposing the black-and-white photothermographic material described above to electromagnetic radiation to form a latent image, and B) simultaneously or sequentially, heating the exposed photothermographic material to develop the latent image into a visible image.

In some embodiments, the photothermographic material has a transparent support and the imaging method of this invention further includes:

C) positioning the exposed and heat-developed photothermographic material between a source of imaging radiation and an imageable material that is sensitive to the imaging radiation, and D) exposing the imageable material to the imaging radiation through the visible image in the exposed and heat-developed photothermographic material to provide a visible image in the imageable material.

The thermographic materials of this invention can also be used to provide a desired black-and-white image by imagewise heating using suitable thermal imaging means and conditions.

This invention also provides a method of preparing a photothermographic material comprising:

A) applying to a support a photothermographic imaging formulation comprising a binder, a silver halide, a non-photosensitive source of reducible silver ions, and a reducing composition for the non-photosensitive source reducible silver ions, and B) simultaneously or subsequently, applying a barrier layer formulation over the photothermographic imaging formulation, the barrier layer formulation comprising a solvent, and a film-forming acrylic or methacrylic acid ester or amide polymer having a molecular weight of at least 8000 g/mole and comprising recurring units derived from one or more ethylenically unsaturated polymerizable acrylic or methacrylic acid ester or amide monomers, wherein from about 15 to 100 mole % of the recurring units in the polymer are derived from such monomers that have hydroxy functionality.

It has been found that the particular barrier layer used in the present invention effectively inhibits (or retards) the diffusion of or reacts with fatty carboxylic acids (such as behenic acid) and other chemicals (such as developers and toners) from thermally developable imaging materials. Thus, the barrier layer reduces the buildup of debris on the processing equipment and improves imaging efficiencies and quality. The barrier layer can be the outermost layer and therefore also serve as a protective overcoat layer for the thermographic and photothermographic materials. Alternatively, the barrier layer can be interposed between the imaging layer(s) and a protective overcoat layer. Still again, a protective layer can be disposed between the barrier layer and the imaging layer(s).

These advantages are achieved by using certain film-forming acrylate and methacrylate polymers having hydroxy functionality in the barrier layer. These polymers are preferably used in admixture with other film-forming polymers, and the combined formulation is believed to provide an excellent chemical and/or physical barrier to the fatty carboxylic acids and other mobile chemicals (such as developers and toners). The hydroxy groups are believed to improve the compatibility of the polymer mixtures, thereby providing improved clarity and reduced haze. In order to insure solubility in the preferred organic coating solvents, the amount of recurring units derived from the noted monomers having hydroxy functionality is at least 15 mole % of all recurring units in the essential barrier layer polymers.

DETAILED DESCRIPTION OF THE INVENTION

The photothermographic materials of this invention can be used, or example, in conventional black-and-white or color photothermography, or in electronically generated black-and-white or color hardcopy recording. They can be used in microfilm applications, in radiographic imaging (for example, digital medical imaging), and industrial radiography. Such applications include, but are not limited to, thoracic imaging, mammography, dental imaging, orthopedic imaging, general medical radiography, therapeutic radiography, veterinary radiography, and autoradiography. Furthermore, the absorbance of these photothermographic materials between 350 and 450 nm is desirably low (less than 0.5), to permit their use in the graphic arts area (for example, imagesetting and photo-typesetting), in the manufacture of printing plates, in contact printing, in duplicating ("duping"), and in proofing. The photothermographic materials of this invention are particularly useful for medical radiography to provide black-and-white images of human or animal subjects.

The remaining disclosure will be directed to the preferred photothermographic materials, but it would be readily apparent that, in view of the teaching presented herein, thermographic materials can be readily prepared and used under the various thermographic imaging conditions known in the art.

In the photothermographic materials of this invention, the components needed for imaging can be in one or more layers. The layer(s) that contain the photocatalyst (such as a photosensitive silver halide), or non-photo-sensitive source of reducible silver ions, or both, are referred to herein as emulsion layer(s). The photocatalyst and the non-photosensitive source of reducible silver ions are in catalytic proximity (or reactive association) and preferably are in the same emulsion layer. The materials are generally sensitive to radiation of from about 300 to about 850 nm.

Various other layers are usually disposed on the "backside" (non-emulsion side) of the materials, including antihalation layer(s), protective layers, antistatic layers, and transport enabling layers.

Various layers are also usually disposed on the "frontside" or emulsion side of the support including the barrier layer described herein, protective topcoat layers, interlayers, opacifying layers, antistatic layers, antihalation layers, acutance layers, conducting layers, subbing or primer layers, auxiliary layers, and other layers readily apparent to one skilled in the art.

The present invention also provides a process for the formation of a visible image (usually a black-and-white image) by first exposing to suitable electromagnetic radiation and thereafter heating the inventive photothermographic material. Thus, in one embodiment, the present invention provides a process comprising:

A) imagewise exposing the photothermographic material of this invention to electromagnetic radiation to which the photocatalyst (for example, a photosensitive silver halide) of the material is sensitive, to generate a latent image, and B) simultaneously or sequentially, heating the exposed material to develop the latent image into a visible black-and-white image.

This visible image can also be used as a mask for exposure of other photosensitive imageable materials, such as graphic arts films, proofing films, printing plates and circuit board films, that are sensitive to suitable imaging radiation (for example UV radiation). This can be done by imaging an imageable material (such as a photopolymer, a diazo material, a photoresist, or a photo-sensitive printing plate through the exposed and heat-developed photothermographic material of this invention using steps C and D noted above.

When the photothermographic materials of this invention are heat-developed as described below in a substantially water-free condition after, or simultaneously with, imagewise exposure, a silver image (preferably a black-and-white silver image) is obtained. The photothermographic material may be exposed in step A with ultraviolet, visible, infrared, or laser radiation using an infrared laser, a laser diode, an infrared laser diode, a light-emitting diode, a light-emitting screen, a CRT tube, or any other radiation source readily apparent to one skilled in the art.

Definitions

As used herein:

In the descriptions of the photothermographic materials of the present invention, "a" or "an" component refers to "at least one" of that component. For example, the chemical materials (including polymers) described herein for the barrier layer can be used individually or in mixtures.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Macmillan 1977, p. 374.

"Photothermographic material(s)" means a construction comprising at least one photothermographic emulsion layer or a photothermographic set of layers (wherein the photocatalyst (such as the photosensitive silver halide) and the source of reducible silver ions are in one layer and the other essential components or desirable additives are distributed, as desired, in an adjacent coating layer) and any supports, topcoat layers, image-receiving layers, blocking layers, antihalation layers, subbing, or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

Thermographic material(s) are similarly defined except that no photosensitive photocatalyst is intentionally present in the imaging layers.

"Emulsion layer," "imaging layer," or "photothermographic emulsion layer" means a layer of a photothermographic material that contains the photosensitive catalyst (for example a photosensitive silver halide) and/or non-photosensitive source of reducible silver ions. It can also mean a layer of the photothermographic material that contains, in addition to the photosensitive silver halide and/or non-photosensitive source of reducible silver ions, additional essential components and/or desirable additives. Similarly, "thermographic emulsion layer" refers to a layer of a thermographic material that contains the non-photosensitive source of reducible silver ions. These layers are usually on what is known as the "frontside" of the support, but in some embodiments can be on both the frontside and backside of the support.

"Ultraviolet region of the spectrum" means that region of the spectrum less than or equal to about 410 nm, preferably from about 100 nm to about 410 nm although parts of these ranges may be visible to the naked human eye. More preferably, the ultraviolet region of the spectrum is the region of from about 190 nm to about 405 nm.

"Visible region of the spectrum" refers to that region of the spectrum of from about 400 nm to about 700 nm.

"Short wavelength visible region of the spectrum" refers to that region of the spectrum from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

"Transparent" means capable of transmitting visible light or imaging radiation without appreciable scattering or absorption.

As is well understood in this area, for compounds useful herein substitution is not only tolerated, but is often advisable and substitution is anticipated on the compounds (including polymers) used in the present invention. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where there is a benzene ring structure shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. For example, the term "alkyl group" is intended to include not only pure hydrocarbon alkyl chains (such as methyl, ethyl, propyl, t-butyl, cyclohexyl, iso-octyl, and octadecyl) but also alkyl chains bearing substituents known in the art, such as hydroxyl, alkoxy, thioalkyl, phenyl, halogen atoms (F, Cl, Br, and I), cyano, nitro, amino, and carboxy, and the like. Thus, alkyl group includes ether and thioether groups (for example $CH_3—CH_2—CH_2—O—CH_2—$ or $CH_3—CH_2—CH_2—S—CH_2—$), haloalkyl, nitroalkyl, carboxyalkyl, hydroxyalkyl, sulfoalkyl, and other groups readily apparent to one skilled in the art. Substituents that adversely react with other active ingredients, such as very strongly electrophilic or oxidizing substituents, would of course be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24$^{th}$ Street, New York, N.Y. 10011).

Other aspects, advantages, and benefits of the present invention are apparent from the detailed description, examples, and claims provided in this application.

Barrier Layer

The advantages of the present invention are achieved by using certain film-forming acrylic and methacrylic acid ester or amide polymers in a barrier layer in the thermographic and photothermographic materials of the invention. The barrier layer is preferably the outermost layer on the "frontside" of those materials. A single homogeneous (that is, uniform throughout) barrier layer is preferred. However, as used herein, "barrier layer" also includes the use of multiple layers containing the same or different polymer composition disposed over the imaging and other layers to provide a barrier "structure" or composite (having multiple strata) that serves as a physical and/or chemical barrier to the diffusion of the various chemical components (such as developers, toners, and fatty carboxylic acids as described below) present in the material or produced during thermal imaging and/or development.

The barrier layer can also act as the outermost surface protective overcoat, but in some embodiments a protective overcoat layer is disposed over the barrier layer and underlying imaging layer(s). For example, protective overcoat layers comprising common overcoat materials such as poly (vinyl butyral), cellulose acetate butyrate, and other film-forming polymers can be disposed over the barrier layer.

In still other embodiments, a protective layer composed of poly(vinyl butyral), cellulose acetate butyrate, or other film-forming polymers can be interposed between the barrier layer and the one or more underlying imaging layers.

The barrier layer is generally transparent and colorless. If it is not transparent and colorless, it must be at least transparent to the wavelength of radiation used to provide and/or view the resulting image. Thus, the barrier layer does not significantly adversely affect the imaging properties of the thermographic and photothermographic materials of this invention, such as the sensitometric properties including minimum density, maximum density and photospeed. That is, haze is desirably as low as possible.

The optimum barrier layer dry thickness depends upon various factors including type of imaging material, thermal imaging and/or development means, desired image, and various imaging components. Generally, the one or more barrier layers have a dry thickness of at least 0.2 $\mu$m, and preferably a dry thickness of from about 1.5 to about 3 $\mu$m. The upper limit to the dry thickness is dependent only upon what is practical for meeting imaging needs.

The barrier layer useful in this invention comprises one or more film-forming acrylic or methacrylic acid ester or amide polymers having hydroxy functionality (also identified herein as "hydroxy polymers") that can be used alone, or can be mixed with one or more additional film-forming polymers that lack hydroxy functionality. The various film-forming polymers used in this layer must be compatible with each other so that a transparent, non-hazy film is provided. Mixtures of the various types of "hydroxy polymers" can also be used. By "film-forming" is meant that the polymers provide a smooth film at temperatures below 250° C.

The "hydroxy polymers" that are useful in the practice of this invention can vary widely in structure and composition. They can include homopolymers derived from hydroxy group-containing ethylenically unsaturated polymerizable acrylic or methacrylic acid ester or amide monomers as well as copolymers formed from two or more acrylic or methacrylic acid ester or amide ethylenically unsaturated polymerizable monomers, at least one of which provides the required hydroxy functionality (that is pendant hydroxy groups). In such instances, the hydroxy functionality is generally provided in the monomers prior to polymerization. Alternatively, polymers can be formed that have pendant chemically reactive groups (such as epoxide, ethers (for example, substituted methyl or ethyl ether, tetrahydrofuranyl or tetrahydropyranyl ether, benzyl ether, or silyl ether), ester, carbonate, cyclic acetal and ketal, cyclic ortho ester, or cyclic carbonate groups) that can be converted to hydroxy groups after the polymer has been formed.

The "hydroxy polymers" are generally vinyl polymers prepared using conventional solution polymerization procedures and starting materials that would be readily apparent to one skilled in the polymer chemistry art. The molecular weight of the useful film-forming polymers is generally at least 8000 g/mole, and preferably the molecular weight is at least 25,000 g/mole.

It is essential that from about 15 to 100 mole % of the total recurring units in the polymers comprise one or more pendant hydroxy groups. Preferably, from about 20 to about 75 mole % (and more preferably from about 30 to 75 mole %) of the total recurring units comprise one or more hydroxy groups.

Besides the "barrier" properties describe herein, the polymers are also preferably more soluble in various polar organic solvents (such as methyl ethyl ketone, methanol, isopropanol, acetone, tetrahydrofuran, and ethyl acetate) that are often used for coating thermally developable layers) than water. The solubility of the film-forming polymers in various solvents can be varied by changing the concentration of hydroxy groups or the type or amount of acrylic or methacrylic acid ester or amide monomer recurring units.

More particularly, the preferred "hydroxy polymers" useful in this invention can be represented by the following Formula I:

$$—(A)_m—(B)_n— \quad \text{I}$$

wherein A represents recurring units derived from one or more ethylenically unsaturated polymerizable acrylic or methacrylic acid ester or amide monomers comprising one or more pendant hydroxy groups, B represents recurring units derived from one or more ethylenically unsaturated polymerizable acrylic or methacrylic acid ester or amide monomers other than those represented by A (that is, not having pendant hydroxy groups), m is from about 15 to 100 mole %, and n is from 0 to about 85 mol %. More preferably, in Formula I, m is from about 20 to about 75 mole % and n is from about 25 to about 80 mole %. Most preferably, m is from about 30 to about 75 mole % and n is from about 25 to about 70 mole %.

The "A" recurring units shown in Formula I can be derived from one or more ethylenically unsaturated polymerizable acrylic or methacrylic acid ester or amide monomers such as 2-hydroxyethyl methacrylate, 2-hydroxyethyl acrylate, 3-chloro-2-hydroxypropyl methacrylate, 2,3-dihydroxypropyl methacrylate, polypropylene glycol methacrylate, 2-hydroxypropyl methacrylate, 3-hydroxypropyl methacrylate, 2-hydroxybutyl methacrylate, 2-hydroxyethyl methacrylamide, 1,3-dihydroxy-2-hydroxymethyl-2-propyl methacrylamide, 3-chloro-2-hydroxypropyl acrylate, 2,3-dihydroxypropyl acrylate, polypropylene-glycol acrylate, 2-hydroxypropyl acrylate, 3-hydroxypropyl acrylate, 2-hydroxy-butyl acrylate, 2-hydroxyethyl acrylamide, and 1,3-dihydroxy-2-hydroxymethyl-2-propyl acrylamide, and others that would be readily apparent to one skilled in the art. Hydroxyethyl methacrylate is most preferred. Most of these monomers can be obtained from a number of commercial sources including Aldrich Chemical Company, TCI America, and Scientific Polymer Products. Other monomers can be prepared using known starting materials and procedures.

The "B" recurring units shown in Formula I can be derived from one or more ethylenically unsaturated polymerizable acrylic or methacrylic acid ester or amide monomers such as methyl acrylate, ethyl acrylate, iso-propyl acrylate, methyl methacrylate, ethyl methacrylate, iso-propyl methacrylate, n-butyl acrylate, t-butyl methacrylate, iso-decyl methacrylate, iso-butyl methacrylate, cyclohexyl methacrylate, cyclohexyl acrylate, lauryl methacrylate, allyl methacrylate, methyl acrylamide, ethyl methacrylamide, and others that would be readily apparent to one skilled in the art. Methyl methacrylate and iso-propyl methacrylate are most preferred. Most of these compounds are readily available from a number of commercial sources including the commercial sources noted above. Other monomers can be prepared using known starting materials and procedures.

Particularly useful polymers are those wherein A represents recurring units derived from 2-hydroxyethyl methacrylate, 2-hydroxyethyl acrylate, or both, and B represents recurring units derived from methyl methacrylate, iso-propyl methacrylate, iso-butyl methacrylate, or mixtures thereof.

Representative film-forming acrylic or methacrylic acid ester or amide polymers having hydroxy functionality that are useful in the practice of this invention include, but are not limited to, the following materials (having various molar ratios as described above):

poly(2-hydroxyethyl methacrylate-co-methyl methacrylate), poly(2-hydroxyethyl methacrylate-co-iso-decyl methacrylate), poly(2-hydroxyethyl methacrylate-co-iso-butyl methacrylate), poly(2-hydroxyethyl methacrylate-co-ethyl methacrylate-co-methyl methacrylate), poly(2-hydroxyethyl acrylate-co-methyl methacrylate), poly(2-hydroxyethyl methacrylate-co-3-chloro-2-hydroxypropyl methacrylate), poly(2-hydroxyethyl methacrylate-co-iso-propyl methacrylate, poly(2-hydroxyethyl methacrylate-co-ethyl methacrylate), poly(2-hydroxyethyl methacrylate), poly(2-hydroxyethyl methacrylate-co-n-butyl methacrylate), poly(2-hydroxyethyl methacrylate-co-n-propyl methacrylate), poly(2-hydroxypropyl methacrylate-co-methyl methacrylate), poly(2-hydroxybutyl methacrylate-co-methyl methacrylate, poly(2-hydroxyethyl methacrylate-co-cyclohexyl methacrylate), or poly(2-hydroxyethyl methacrylate-co-t-butyl methacrylate).

The most preferred "hydroxy polymers" are poly(2-hydroxyethyl methacrylate-co-methyl methacrylate), poly (2-hydroxyethyl methacrylate-co-iso-butyl methacrylate), and poly(2-hydroxyethyl methacrylate-co-isopropyl methacrylate) having various molar ratios as described above.

If desired, the polymers described above can be crosslinked or contain crosslinkable moieties using polymer chemistry known to one skilled in the art, for example by using diacrylate or dimethacrylate monomers in formation of the polymers.

The "additional" film-forming polymers that can also be present in the barrier layer mixed with the "hydroxy polymers". These additional polymers can be of any structure or composition as long as they are film-forming (as defined above), compatible with the "hydroxy polymers," provide scratch-resistant films, and are stable at thermal development temperatures and conditions. They may or may not contain hydroxy functionality. Such polymers can be cellulosic materials, polyacrylates (including copolymers), polymethacrylates (including copolymers), polyesters, and polyurethanes. Such materials can be obtained from a number of commercial sources including Eastman Chemical Company and DuPont or they can be prepared using known starting materials and procedures. The polyacrylates and polymethacrylates, for example, can be prepared from the various acrylate and methacrylate monomers described above in the definition of the "B" recurring units, with or without other ethylenically unsaturated polymerizable monomers that are not acrylates or methacrylates. Mixtures of these "additional" polymers can be used if desired.

It would be apparent to one skilled in the art that some "additional" polymers are more compatible in mixtures with certain "hydroxy polymers" than others. Thus, a skilled artisan would use routine experimentation in view of the teaching provided herein to find the appropriate and desirable mixtures of film-forming polymers to provide optimum barrier layers.

The cellulosic materials are preferred for use in the practice of this invention as "additional" polymers. Such materials include but are not limited to, cellulose acetate, cellulose acetate butyrate, cellulose acetate propionate, and cellulose derivatives as described in E. Doelker, *Advances in Polymer Science*, Vol. 107, pp. 199–265. Mixtures of cellulose polymers can be used if desired. Cellulose acetate butyrate is preferred as an "additional" polymer when mixed with preferred "hydroxy polymers."

In the barrier layer used in this invention, the film-forming "hydroxy polymers" generally comprise from about 25 to about 100 weight %, and preferably from about 50 to 100 weight %, based on total dry barrier layer weight. The "additional" film-forming polymers generally comprise from 0 to about 75 weight %, and preferably from 0 to about 50 weight %, based on total dry barrier layer weight.

The barrier layer(s) can also include various addenda such as surfactants, lubricants, matting agents, crosslinking agents, photothermographic toners, acutance dyes and other chemicals that would be readily apparent to one skilled in the art, depending upon whether the barrier layer is on the outer surface or underneath another layer. These components can be present in conventional amounts.

The barrier layers can be applied to other layers in the thermographic or photothermographic materials using any suitable technique (see coating described below). Generally, the components of the layers are coated as a barrier layer formulation having predominantly (at least 50 weight %) one or more suitable polar organic solvents such as methyl ethyl ketone, acetone, tetrahydrofuran, methanol, or mixtures of any of these at from about 2 to about 35% solids, and then dried.

Alternatively, the barrier layers can be formulated in and coated as an aqueous formulation wherein water comprises at least 50 weight % of the total amount of solvents, and the rest of the solvents being polar organic solvent as described above. Components of the layer(s) can be dissolved or dispersed within such coating formulations using known procedures.

Thus, in preferred embodiments, this invention provides a black-and-white photothermographic material comprising a support having on one side thereof:

a) one or more thermally developable imaging layers comprising a binder and in reactive association, a photosensitive silver halide, one or more non-photosensitive silver carboxylates composed of fatty carboxylic acids having 10 to 30 carbon atoms, or a mixture of the silver carboxylates, including at least silver behenate, and a hindered phenol reducing agent for the silver fatty acid carboxylates, b) a barrier layer that is farther from the support than the one or more imaging layers, the barrier layer comprising one or more film-forming acrylate or methacrylate polymers, each having a molecular weight of at least 8000 g/mole and being represented by Formula I:

$$—(A)_m—(B)_n— \qquad \text{I}$$

wherein A represents recurring units derived from one or more ethylenically unsaturated polymerizable acrylicate or methacrylicate acid ester or amide monomers comprising one or more hydroxy groups, B represents recurring units derived from one or more ethylenically unsaturated polymerizable acrylic or methacrylic acid ester or amide other than those represented by A, m is from about 15 to 100 mole %, and n is from 0 to about 85 mole %, the barrier layer being capable of retarding diffusion of or reacting with the fatty carboxylic acids, and the film-forming acrylate or methacrylate polymer being present in the barrier layer in an amount of from about 25 to 100 weight %, and the one or more additional film-forming polymers being present in the barrier layer in an amount of from 0 to about 75 weight %, based on the total dry weight of the barrier layer, one or more additional film-forming polymers being cellulosic materials, polyacrylates, polymethacrylates, polyesters or polyurethanes.

The Photocatalyst

As noted above, the photothermographic materials of the present invention include one or more photocatalysts in the photothermographic emulsion layer(s). Useful photocatalysts include, but are not limited to, silver halides, titanium oxide, cupric salts [such as copper (II) salts)], zinc oxide, cadmium sulfide, and other photocatalysts that would be readily apparent to one skilled in the art.

Preferred photocatalysts are photosensitive silver halides such as silver bromide, silver iodide, silver chloride, silver bromoiodide, silver chloro-bromoiodide, silver chlorobromide, and others readily apparent to one skilled in the art. Mixtures of various types of silver halides can also be used in any suitable proportion. Silver bromide and silver bromoiodide are more preferred, the latter silver halide including up to 10 mol % silver iodide. Typical techniques for preparing and precipitating silver halide grains are described in *Research Disclosure*, 1978, Item 17643.

The shape of the photosensitive silver halide grains used in the present invention is in no way limited. The silver halide grains may have any crystalline habit including, but not limited to, cubic, octahedral, rhombic, dodecahedral, orthorhombic, tetrahedral, other polyhedral, laminar, twinned, platelet, or tabular morphologies and may have epitaxial growth of crystals thereon. If desired, a mixture of these crystals can be employed. Silver halide grains having cubic and tabular morphology are preferred.

The photosensitive silver halide grains may have a uniform ratio of halide throughout. They may have a graded halide content, with a continuously varying ratio of, for example, silver bromide and silver iodide or they may be of the core-shell-type, having a discrete core of one halide ratio, and a discrete shell of another halide ratio. Core-shell silver halide grains useful in photothermographic materials and methods of preparing these materials are described for example, in U.S. Pat. No. 5,382,504 (Shor et al.), incorporated herein by reference. Iridium and/or copper doped core-shell grains of this type are described in U.S. Pat. No. 5,434,043 (Zou et al.), U.S. Pat. No. 5,939,249 (Zou), and EP-A-0 627 660 (Shor et al.), incorporated herein by reference.

In some instances, it may be helpful to prepare the photosensitive silver halide grains in the presence of a hydroxytetrazaindene (such as 4-hydroxy-6-methyl-1,3,3, 3a,7-tetrazaindene) or an N-heterocyclic compound comprising at least one mercapto group (such as 1-phenyl-5-mercaptotetrazole) to provide increased photospeed. Details of this procedure are provided in copending and commonly assigned U.S. Ser. No. 09/833,533 (filed Apr. 21, 2001 by Shor, Zou, Ulrich, and Simpson), incorporated herein by reference.

The photosensitive silver halide grains used in the present invention can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized, such lower limit, for example being about 0.01 or 0.005 $\mu$m.

The average size of the photosensitive silver halide grains is expressed by the average diameter if the grains are spherical and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

The photocatalyst can be added to (or formed within) the emulsion layer(s) in any fashion as long as long as it is placed in catalytic proximity to the non-photosensitive source of reducible silver ions.

For the preferred photocatalysts, it is preferred that the silver halide be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ prepared silver halide. In this process, the source of reducible silver ions, such as a long chain fatty acid silver carboxylate (commonly referred to as a silver "soap") is formed in the presence of the preformed silver halide grains. Co-precipitation of the reducible source of silver ions in the presence of silver halide provides a more intimate mixture of the two materials [see, for example, U.S. Pat. No. 3,839,049 (Simons)]. Materials of this type are often referred to as "preformed soaps."

Preformed silver halide emulsions used in the materials of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.), all incorporated herein by reference].

It is also effective to use an in situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), and JP Applications 13224/74, 42529/76, and 17216/75, all incorporated herein by reference.

The one or more photocatalysts (preferably, light-sensitive silver halides) used in the photothermographic materials of the present invention are preferably present in an amount of from about 0.005 to about 0.5 mole, more preferably from about 0.01 to about 0.25 mole per mole, and most preferably from about 0.03 to about 0.15 mole, per mole of non-photosensitive source of reducible silver ions.

Chemical and Spectral Sensitizers

The photosensitive silver halides (the preferred photocatalyst) used in this invention may be employed without modification. However, they are preferably chemically and/or spectrally sensitized in a manner similar to that used to sensitize conventional wet-processed silver halide photographic materials or state-of-the-art heat-developable photothermographic materials.

Thus, the photosensitive silver halides may be chemically sensitized with one or more chemical sensitizing agents, such as a compound containing sulfur, selenium, or tellurium, or with a compound containing gold, platinum, palladium, ruthenium, rhodium, iridium, or combinations thereof, a reducing agent such as a tin halide or a combination of any of these. The details of these procedures are described in T. H. James, *The Theory of the Photographic Process*, Fourth Edition, Chapter 5, pp. 149–169. Suitable chemical sensitization procedures are also disclosed in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915 371 (Lok et al.), all incorporated herein by reference. Mixtures of one or more types of chemical sensitizing agents can also be used.

One method of chemical sensitization is by oxidative decomposition of a spectral sensitizing dye in the presence of a photothermographic emulsion, as described in U.S. Pat. No. 5,891,615 (Winslow et al.) incorporated herein by reference.

Sulfur-containing chemical sensitizers useful in the present invention are well known in the art and described for example, in Sheppard et al., *J. Franklin Inst.*, 1923, 196, pp.

653 and 673, C. E. K. Mees and T. H. James, *The Theory of the Photographic Process*, Fourth Edition, 1977, pp. 152–3, Tani, T., *Photographic Sensitivity: Theory and Mechanisms*, Oxford University Press, N.Y., 1995, pp. 167–176, U.S. Pat. No. 5,891,615 (Winslow et al.), Zavlin et al., IS&T's 48$^{th}$ Annual Conference Papers, May 7–11 1995 Washington D.C., pp. 156-6), U.S. Pat. No. 4,810,626 (Burgmaier et al.), U.S. Pat. No. 4,036,650 (Kobayashi et al.), U.S. Pat. No. 4,213,784 (Ikenoue et al.), and U.S. Pat. No. 4,207,108 (Hiller), all incorporated herein by reference.

Particularly useful sulfur-containing chemical sensitizers are tetrasubstituted thiourea ligands, preferably such thiourea compounds that are substituted with the same or different aliphatic substituents, and more preferably, those that are substituted with the same aliphatic substituent. Such useful thioureas are described for example in U.S. Pat. No. 5,843,632 (Eshelman et al.) and in copending and commonly assigned U.S. Ser. No. 09/667,748 (filed Sep. 21, 2000 by Lynch, Simpson, Shor, Willett, and Zou, incorporated herein by reference.

Particularly, useful tellurium-containing chemical sensitizing compounds are described in copending and commonly assigned U.S. Ser. No. 09/746,400 (filed Dec. 21, 2000 by Lynch, Opatz, Shor, Simpson, Willett, and Gysling), incorporated herein by reference.

Useful combinations of sulfur- or tellurium-containing chemical sensitizers with gold(III)-containing chemical sensitizers are described in copending and commonly assigned U.S. Ser. No. 09/768,094 (filed Jan. 24, 2001 by Simpson, Whitcomb, and Shor), incorporated herein by reference.

The total amount of chemical sensitizers that may be used during formulation of the imaging composition will generally vary depending upon the average size of silver halide grains. The total amount is generally at least $10^{-10}$ mole per mole of total silver, and preferably from $10^{-8}$ to about $10^{-2}$ mole per mole of total silver for silver halide grains having an average size of from about 0.01 to about 2 $\mu$m. The upper limit can vary depending upon the compound used, the level of silver halide and the average grain size, and it would be readily determinable by one of ordinary skill in the art.

In general, it may also be desirable to add spectral sensitizing dyes to enhance silver halide sensitivity to ultraviolet, visible, and infrared light. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes, merocyanine dyes and complex merocyanine dyes are particularly useful. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.) and U.S. Pat. No. 5,541,054 (Miller et al.), U.S. Pat. No. 5,281,515 (Delprato et al.), and U.S. Pat. No. 5,314,795 (Helland et al.), all incorporated herein by reference, are effective in the practice of the invention.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in thermographic and photothermographic materials of this invention can be any material that contains reducible silver (1+) ions. Preferably, it is a silver salt that is comparatively stable to light and forms a silver image when heated to 50° C. or higher in the presence of an exposed photocatalyst (such as silver halide, when used) and a reducing agent composition.

Silver salts of organic acids, particularly silver salts of long-chain fatty carboxylic acids are preferred. The chains typically contain 10 to 30, and preferably 15 to 28, carbon atoms. Suitable organic silver salts include silver salts of organic compounds having a carboxylic acid group. Examples thereof include silver salts of aliphatic carboxylic acids and silver salts of aromatic carboxylic acids. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Most preferably, at least silver behenate is present as the non-photosensitive source of reducible silver ions.

Preferred examples of the silver salts of aromatic carboxylic acid and other carboxylic acid group-containing compounds include, but are not limited to, silver benzoate, a silver-substituted benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates having increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described for example in U.S. Pat. No. 4,504,575 (Lee). Silver salts of sulfosuccinates are also useful as described for example in EP-A-0 227 141 (Leenders et al.).

Silver salts of compounds containing mercapto or thione groups and derivatives thereof can also be used. Preferred examples of these compounds include, but are not limited to, a silver salt of 3-mercapto4-phenyl-1,2,4-triazole, a silver salt of 2-mercaptobenzimidazole, a silver salt of 2-mercapto-5-amino-thiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,201,678 (Meixell)].

Furthermore, a silver salt of a compound containing an imino group can be used. Preferred examples of these compounds include but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described for example in U.S. Pat. No. 4,761,361 (Ozaki et al.) and U.S. Pat. No. 4,775,613 (Hirai et al.).

It may also be convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films a silver carboxylate full soap, containing not more than about 15% of free fatty carboxylic acid and analyzing about 22% silver, can be used. For opaque photothermographic materials, different amounts can be used.

Non-photosensitive sources of reducible silver ions can also provided as core-shell silver salts such as those described in commonly assigned and copending U.S. Ser. No. 09/761,954 (filed Jan. 17, 2001 by Whitcomb and Pham), incorporated herein by reference. These silver salts include a core comprised of one or more silver salts and a shell having one or more different silver salts.

Still another useful source of non-photosensitive reducible silver ions in the practice of this invention are the silver dimer compounds that comprise two different silver salts as described in copending U.S. Ser. No. 09/812,597 (filed Mar. 20, 2001 by Whitcomb), incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.), and the references cited above.

The source of non-photosensitive reducible silver ions is preferably present in an amount of about 5% by weight to about 70% by weight, and more preferably, about 10% to about 50% by weight, based on the total dry weight of the emulsion layers. Stated in another way, the amount of the source of reducible silver ions is generally present in an amount of from about 0.001 to about 0.5 mol/m$^2$ of dried photothermographic material, and preferably from about 0.01 to about 0.05 mol/m$^2$ of that material.

When used in photothermographic materials, the photocatalyst and the non-photosensitive source of reducible silver ions must be in catalytic proximity (that is reactive association). "Catalytic proximity" or "reactive association" means that they should be in the same emulsion layer or in adjacent layers. It is preferred that these reactive components be present in the same emulsion layer.

When a silver halide is the photocatalyst, the total amount of silver (from all silver sources) in the photothermographic materials is generally at least 0.002 mol/m$^2$, and preferably from about 0.01 to about 0.05 mol/m$^2$.

Reducing Agents

The reducing agent (or reducing agent composition comprising two or more components) for the source of reducible silver ions can be any material, preferably an organic material, that can reduce silver (1+) ion to metallic silver. Conventional photographic developers such as methyl gallate, hydroquinone, substituted hydroquinones, hindered phenols, amidoximes, azines, catechol, pyrogallol, ascorbic acid (and derivatives thereof), leuco dyes and other materials readily apparent to one skilled in the art can be used in this manner as described for example in U.S. Pat. No. 6,020,117 (Bauer et al.), incorporated herein by reference.

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes described below.

Hindered phenol reducing agents are preferred (alone or in combination with one or more high contrast co-developing agents and contrast enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxy-binaphthyls), biphenols (that is dihydroxybiphenyls), bis(hydroxynaphthyl)-methanes, bis(hydroxyphenyl)methanes, hindered phenols, and hindered naphthols, each of which may be variously substituted.

Representative binaphthols include, but are not limited to, 1,1'-bi-2-naphthol, 1,1'-bi4-methyl-2-naphthol, and 6,6'-dibromo-bi-2-naphthol. For additional compounds, see U.S. Pat. No. 3,094,417 (Workman) and U.S. Pat. No. 5,262,295 (Tanaka et al.), both incorporated herein by reference.

Representative biphenols include, but are not limited to, 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichloro-biphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds, see U.S. Pat. No. 5,262,295 (noted above).

Representative bis(hydroxynaphthyl)methanes include, but are not limited to, 4,4'-methylenebis(2-methyl-1-naphthol). For additional compounds, see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1-bis(2-hydroxy-3,5-dimethylphenyl)-3,5,5-trimethylhexane (NONOX or PERMANAX WSO), 1,1-bis(3,5-di-t-butyl-4-hydroxyphenyl)methane, 2,2-bis(4-hydroxy-3-methylphenyl)propane, 4,4-ethylidene-bis(2-t-butyl-6-methylphenol), 2,2'-isobutylidene-bis(4,6-dimethylphenol) (LOWINOX 221B46), and 2,2-bis(3,5-dimethyl-4-hydroxyphenyl)propane. For additional compounds, see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems include amidoximes such as phenylamidoxime, 2-thienyl-amidoxime and p-phenoxyphenylamidoxime, azines (for example 4-hydroxy-3,5-dimethoxybenzaldehydrazine), a combination of aliphatic carboxylic acid aryl hydrazides and ascorbic acid, such as 2,2'-bis(hydroxymethyl)propionyl-β-phenyl hydrazide in combination with ascorbic acid, a combination of polyhydroxy-benzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alanine-hydroxamic acid), a combination of azines and sulfonamidophenols (for example phenothiazine and 2,6-dichloro-4-benzenesulfonamidophenol), α-cyanophenyl-acetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)-methane], a combination of bis-o-naphthol and a 1,3-dihydroxybenzene derivative (for example 2,4-dihydroxybenzophenone or 2,4-dihydroxyacetophenone), 5-pyrazolones such as 3-methyl-1-phenyl-5-pyrazolone, reductones (such as dimethylamino-hexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1 4-dihydropyridine), ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described for example in U.S. Pat. No. 3,074,809 (Owen), U.S. Pat. No. 3,094,417 (Workman), U.S. Pat. No. 3,080,254 (Grant, Jr.), and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in copending U.S. Ser. No. 09/239,182 (filed Jan. 28, 1999 by Lynch and Skoog), incorporated herein by reference. Examples of these compounds include, but are not limited to, 2,5-dioxo-cyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and fonnyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers are substituted acrylonitrile compounds that can be represented by structure II as follows:

$$H(R')C{=}C(R)CN \qquad \text{II}$$

II wherein R is a substituted or unsubstituted aryl group of 6 to 14 carbon atoms in the single or fused ring structure (such as phenyl, naphthyl, p-methylphenyl, p-chlorophenyl, 4-pyridinyl and o-nitrophenyl groups) or an electron withdrawing group (such as a halo atom, cyano group, carboxy group, ester group and phenylsulfonyl group). R' is a halo group (such as fluoro, chloro and bromo), hydroxy or metal salt thereof, a thiohydrocarbyl group, an oxyhydroxycarbyl group, or a substituted or unsubstituted 5- or 6-membered aromatic heterocyclic group having only carbon atoms and 1 to 4 nitrogen atoms in the central ring (with or without fused rings attached), and being attached through a non-quatemary ring nitrogen atom (such as pyridyl, furyl, diazolyl, triazolyl, pyrrolyl, tetrazolyl, benzotriazolyl, benzopyrrolyl and quinolinyl groups). Further details of these compounds and their preparation can be found in U.S. Pat. No. 5,635,339 (Murray) and U.S. Pat. No. 5,545,515 (Murray et al.), both incorporated herein by reference.

Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene) cyanoacetates and their metal salts.

Various contrast enhancers can be used in some photothermographic materials with specific co-developers. Examples of useful contrast enhancers include, but are not limited to, hydroxylamines (including hydroxyl-amine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Haring et al.). All of the above patents are incorporated herein by reference.

The reducing agent (or mixture thereof) described herein is generally present as 1 to 20% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the imaging layer coating. desirable.

For color imaging materials (for example, monochrome, dichrome, or full color images), one or more reducing agents can be used that can be oxidized directly or indirectly to form or release one or more dyes.

The dye-forming or releasing compound may be any colored, colorless or lightly colored compound that can be oxidized to a colored form, or to release a preformed dye when heated, preferably to a temperature of from about 80° C. to about 250° C. for a duration of at least 1 second. When used with a dye- or image-receiving layer, the dye can diffuse through the imaging layers and interlayers into the image-receiving layer of the photothermographic material.

Leuco dyes or "blocked" leuco dyes are one class of dye-forming compounds (or "blocked" dye-forming compounds) that form and release a dye upon oxidation by silver ion to form a visible color image in the practice of the present invention. Leuco dyes are the reduced form of dyes that are generally colorless or very lightly colored in the visible region (optical density of less than 0.2). Thus, oxidation provides a color change that is from colorless to colored, or an optical density increase of at least 0.2 units or a substantial change in hue.

Representative classes of useful leuco dyes include, but are not limited to, chromogenic leuco dyes (such as indoaniline, indophenol, or azomethine dyes), imidazole leuco dyes such as 2-(3,5-di-t-butyl-4-hydroxy-phenyl)-4,5-diphenylimidazole as described for example in U.S. Pat. No. 3,985,565 (Gabrielson et al.), dyes having an azine, diazine, oxazine, or thiazine nucleus such as those described for example in U.S. Pat. No. 4,563,415 (Brown et al.), U.S. Pat. No. 4,622,395 (Bellus et al.), U.S. Pat. No. 4,710,570 (Thien), and U.S. Pat. No. 4,782,010 (Mader et al.), and benzlidene leuco compounds as described for example in U.S. Pat. No. 4,932,792 (Grieve et al.), all incorporated herein by reference. Further details about the chromogenic leuco dyes noted above can be obtained from U.S. Pat. No. 5,491,059 (noted above, Column 13) and references noted therein.

Another useful class of leuco dyes are what are known as "aldazine" and "ketazine" leuco dyes, which are described for example in U.S. Pat. No. 4,587,211 (Ishida et al.) and U.S. Pat. No. 4,795,697 (Vogel et al.), both incorporated herein by reference.

Still another useful class of dye-releasing compounds are those that release diffusible dyes upon oxidation. These are known as preformed dye release (PDR) or redox dye release (RDR) compounds. In such compounds, the reducing agents release a mobile preformed dye upon oxidation. Examples of such compounds are described in U.S. Pat. No. 4,981,775 (Swain), incorporated herein by reference.

Further, other useful image-forming compounds are those in which the mobility of a dye moiety changes as a result of an oxidation-reduction reaction with silver halide, or a nonphotosensitive silver salt at high temperature, as described for example in JP Kokai 165,054/84.

Still further the reducing agent can be a compound that releases a conventional photographic dye forming color coupler or developer upon oxidation as is known in the photographic art.

The dyes that are formed or released can be the same in the same or different imaging layers. A difference of at least 60 nm in reflective maximum absorbance is preferred. More preferably, this difference is from about 80 to about 100 nm. Further details about the various dye absorbances are provided in U.S. Pat. No. 5,491,059 (noted above, Col. 14).

The total amount of one or more dye- forming or releasing compound that can be incorporated into the photothermographic materials of this invention is generally from about 0.5 to about 25 weight % of the total weight of each imaging layer in which they are located. Preferably, the amount in each imaging layer is from about 1 to about 10 weight %, based on the total dry layer weight. The useful relative proportions of the leuco dyes would be readily known to a skilled worker in the art.

Other Addenda

The thermographic and photothermographic materials of the invention can also contain other additives such as shelf-life stabilizers, toners, antifoggants, contrast enhancers, development accelerators, acutance dyes, post-processing stabilizers or stabilizer precursors, and other image-modifying agents as would be readily apparent to one skilled in the art.

For example, to further control the properties of photothermographic materials, (such as, contrast, $D_{min}$, speed, or fog), it may be preferable to add one or more heteroaromatic mercapto compounds or heteroaromatic disulfide compounds as "supersensitizers". Examples include compounds of the formulae: Ar—S—M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthiimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. Many of the above compounds are described in EP-A-0 559 228 (Philip Jr. et al.) as supersensitizers for infrared photothermographic materials.

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenz-imidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

The photothermographic materials of the present invention can be further protected against the production of fog and can be stabilized against loss of sensitivity during storage. While not necessary for the practice of the invention, it may be advantageous to add a mercury (II) salt to the imaging layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), mercury salts as described in U.S. Pat. No. 2,728,663 (noted above), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum and gold salts as described in U.S. Pat. No. 2,566,263 (Trirelli), and U.S. Pat. No. 2,597,915 (Damshroder), and 2-(tribromomethylsulfonyl)quinoline compounds as described in U.S. Pat. No. 5,460,938 (Kirk et al.). Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

Particularly useful antifoggants are polyhalo antifoggants, such as those having a $—SO_2C(X')_3$ group wherein X' represents the same or different halogen atoms.

In addition, certain sulfonyl-substituted derivatives of benzo-triazoles (for example alkylsulfonylbenzotriazoles and arylsulfonylbenzotriazoles) have been found to be useful stabilizing compounds (such as for post-processing print stabilizing), as described in U.S. Pat. No. 6,171,767B1 (Kong et al.), incorporated herein by reference.

Furthermore, other useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), compounds having $—SO_2CBr_3$ groups as described, for example, in U.S. Pat. No. 5,594,143 (Kirk et al.) and U.S. Pat. No. 5,374,514 (Kirk et al.), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in EP-A-0 600,589 (Philip, Jr. et al.) and EP-A-0 600,586 (Philip, Jr. et al.), and tribromomethylketones as described, for example, in EP-A-0 600,587 (Oliff et al.).

Preferably, the photothermographic materials of this invention include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

The use of "toners" or derivatives thereof that improve the image is highly desirable. Preferably, if used, a toner can be present in an amount of about 0.01% by weight to about 10%, and preferably at from about 0.1% to about 10% by weight, based on the total dried weight of the layer in which it is included. Toners may be incorporated in the thermographic or photothermographic emulsion layer or in an adjacent layer. Toners are well known materials in the thermographic and photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.), and GB 1,439,478 (AGFA).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes (such as hexaaminecobalt (III) trifluoroacetate), mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(amino-methyl)aryldicarboximides [such as (N,N-dimethylaminomethyl)phthalimide, and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethyl-pyrazole), 1,8-(3,6-diazaoctane)bis(isothiuronium)trifluoroacetate, and 2-(tribromomethylsulfonyl benzothiazole)], merocyanine dyes {such as 3-ethyl- 5-[(3-ethyl-2-benzothiazolinylidene)-1-methyl-ethylidene]-2-thio-2,4-o-azolidine-dione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazine-dione], a combination of phthalazine (or derivative thereof) plus one or more phthalic acid derivatives (such as phthalic acid, 4-methylphthalic acid, 4-nitro-phthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate (III), rhodium bromide, rhodium nitrate, and potassium hexachlororhodate (III)], benzoxazine-2,4-diones (such as 1,3-benz-oxazine-2,4-dione, 8-methyl-1,3-benzoxazine-2,4-dione and 6-nitro-1,3-benz-oxazine-2,4-dione), pyrimidines and asym-triazines (such as 2,4-dihydroxy-pyrimidine, 2-hydroxy-4-aminopyrimidine and azauracil) and tetraazapentalene derivatives [such as 3,6-dimercapto-1,4-dipheny1-1H,4H-2,3a,5,6a-tetraazapentalene and 1,4-di-(o-chlorophenyl)-3,6-dimercapto-1H,4H-2,3a,5,6a-tetra-azapentalene].

Phthalazine and various phthalazine derivatives [such as described in U.S. Pat. No. 6,146,822 (noted above), incorporated herein by reference] are particularly useful toners.

Binders

The photocatalyst (such as photosensitive silver halide for photothermographic materials), when used, the non-photosensitive source of reducible silver ions, the reducing agent composition, and any other additives used in the present invention are generally present in one or more layers admixed within at least one binder that is either hydrophilic or hydrophobic. Thus, either aqueous or solvent-based formulations can be used to prepare the thermographic or photothermographic materials of this invention. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and PIOLOFORM BS-18 or PIOLOFORM BL-16 (Wacker Chemical Company).

Examples of useful hydrophilic binders include, but are not limited to, gelatin and gelatin-like derivatives (hardened or unhardened), cellulosic materials such as hydroxymethyl cellulose, acrylamide/methacrylamide polymers, acrylic/methacrylic acid polymers polyvinyl pyrrolidones, polyvinyl alcohols and polysaccharides (such as dextrans and starch ethers).

Hardeners for various binders (especially hydrophilic binders) may be present if desired. Useful hardeners are well known and include diisocyanate compounds as described for example in EP-0 600 586 B1 and vinyl sulfone compounds as described in EP-0 600 589 B1.

Where the proportions and activities of the thermographic and photothermographic materials require a particular developing time and temperature, the binder(s) should be able to withstand those conditions. Generally, it is preferred that the binder not decompose or lose its structural integrity at 120° C. for 60 seconds, and more preferred that it not decompose or lose its structural integrity at 177° C. for 60 seconds.

The polymer binder(s) is used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which they are included.

Support Materials

The thermographic and photothermographic materials of this invention comprise a polymeric support that is preferably a flexible, transparent film that has any desired thickness and is composed of one or more polymeric materials depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonate, and polystyrenes (and polymers of styrene derivatives). Preferred supports are composed of polymers having good heat stability, such as polyesters and polycarbonate. Polyethylene terephthalate film is the most preferred support. Various support materials are described, for example, in *Research Disclosure* August 1979, publication 18431. A method of making dimensionally stable polyester films is described in *Research Disclosure*, September, 1999, publication 42536.

Opaque supports can also be used such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials including vinylidene halide polymers.

Thermographic and Photothermographic Formulations

The formulations for the emulsion layer(s) is preferably prepared by dissolving and/or dispersing a hydrophobic binder, the thermographic or photothermographic emulsion [generally including the photocatalyst (when used), the non-photosensitive source of reducible silver ions], the reducing agent composition, and optional addenda in a suitable polar organic solvent, such as toluene, 2-butanone, acetone, or tetrahydrofuran. As noted above, these components can be distributed between two or more imaging layers. In some instances, some of the components can be formulated in a topcoat or surface overcoat layer formulation and allowed to migrate into lower imaging layers.

Alternatively, these components can be formulated with a hydrophilic binder in water or water-organic solvent mixtures to provide aqueous-based coating formulations.

Thermographic and photothermographic materials can also contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads, including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-A-0 792 476 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers, or other procedures described in the noted publication.

The thermographic and photothermographic materials can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The thermographic and photothermographic materials can be constructed of one or more layers on a support. Single layer materials should contain the photocatalyst (such as a photosensitive silver halide, when used), the non-photosensitive source of reducible silver ions, the reducing composition, the binder, as well as optional materials such as toners, acutance dyes, coating aids and other adjuvants.

Constructions comprising a single imaging layer coating containing all the ingredients and a barrier layer and optionally a protective overcoat layer are generally found in the materials of this invention. However, multi-layer constructions containing photosensitive silver halide and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another are also known, as described for example, in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example, in U.S. Pat. No. 5,928,857 (Geisler et al.).

The barrier layers described herein can be provided in various arrangements in the thermographic and photothermographic materials of this invention, but all instances, the barrier layer is farther from the support than all imaging layer(s). In one embodiment, the barrier layer is provided as the sole layer over the imaging layer(s) and thus also functions as a surface overcoat layer. Such barrier layers can include "hydroxy" polymers as the sole film-forming polymers, but preferably additional film-forming polymers [such as cellulosic materials, polyacrylates (including copolymers), polymethacrylates (including copolymers), polyesters, and polyurethanes] are also included in the barrier layer formulations. Cellulose acetate butyrate is the most preferred additional film-forming polymer.

In other embodiments of this invention, a barrier layer formulation is applied over the imaging layer(s) while the imaging layer(s) are wet or after they are dried to provide a barrier layer over the imaging layer(s). Simultaneously or subsequently to application of the barrier layer formulation, a protective overcoat layer formulation can be applied over the barrier and this formulation can include any suitable organic solvent and one or more film-forming polymers known for this purpose. Preferably, such protective overcoat layer formulations include cellulosic materials, polyacrylates (including copolymers), polymethacrylates (including copolymers), polyesters, and polyurethanes. Cellulose acetate butyrate is most preferred for this purpose.

Photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers, described above, may be used. Such formulations are described in copending and commonly assigned U.S. Ser. No. 09/510,648 (filed Feb. 23, 2000 by Ludemann, LaBelle, Geisler, Warren, Crump, and Bhave), incorporated herein by reference.

Mottle and other surface anomalies can be reduced in the materials of this invention by incorporation of a fluorinated polymer as described for example, in U.S. Pat. No. 5,532,121 (Yonkoski et al.) or by using particular drying techniques as described, for example, in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, manufacturing methods can also include forming on the opposing or backside of said polymeric support, one or more additional layers, including an antihalation layer, an antistatic layer, or a layer containing a matting agent (such as silica), or a combination of such layers. It is also contemplated that the photothermographic materials of this invention can include emulsion layers on both sides of the support.

To promote image sharpness, photothermographic materials can contain one or more layers containing acutance and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials of this invention contain an antihalation coating on the support opposite to the side on which the emulsion and topcoat layers are coated.

Dyes particularly useful as antihalation and acutance dyes include dihydroperimidine squaraine dyes having the nucleus represented by the following general structure:

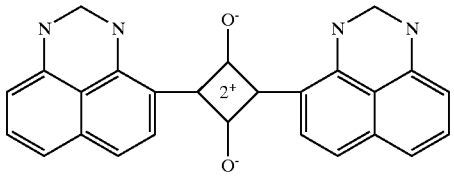

Details of such dyes having the dihydroperimidine squaraine nucleus and methods of their preparation can be found in U.S. Pat. No. 6,063,560 (Suzuki et al.) and U.S. Pat. No. 5,380,635 (Gomez et al.), both incorporated herein by reference. These dyes can also be used as acutance dyes in frontside layers of the materials of this invention. One particularly useful dihydroperimidine squaraine dye is cyclobutenediylium, 1,3-bis[2,3-dihydro-2,2-bis[[1-oxohexyl)oxy]methyl]-1H-perimidin-4-yl]-2,4-dihydroxy-, bis(inner salt).

Dyes particularly useful as antihalation dyes in a backside layer of the photothermographic material also include indolenine cyanine dyes having the nucleus represented by the following general structure:

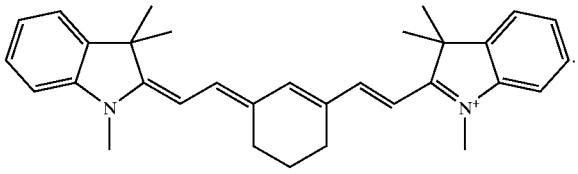

Details of such antihalation dyes having the indolenine cyanine nucleus and methods of their preparation can be found in EP-A-0 342 810 (Leichter), incorporated herein by reference. One particularly useful cyanine dye, compound (6) described therein, is 3H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate.

It is also possible to employ acutance or antihalation dyes that will decolorize with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), and EP-A-0 911 693 (Sakurada et al.).

Imaging/Development

While the thermographic and photothermographic materials of the present invention can be imaged in any suitable manner consistent with the type of material using any suitable imaging source (typically some type of heating, radiation or electronic signal), the following discussion will be directed to the preferred imaging means for photothermographic materials. Generally, such materials are sensitive to radiation in the range of from about 300 to about 850 nm.

Imaging of photothermographic materials can be achieved by exposing the materials to a suitable source of radiation to which they are sensitive, including ultraviolet light, visible light, near infrared radiation and infrared radiation to provide a latent image. Suitable exposure means are well known and include laser diodes that emit radiation in the desired region, photodiodes and others described in the art, including *Research Disclosure*, Vol. 389, Publication 38957, September 1996 (such as sunlight, xenon lamps, and fluorescent lamps). Particularly useful exposure means are laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C., and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent. The second heating step prevents further development.

When using a thermographic material of the present invention, the image may be provided and developed simultaneously merely by heating at the above noted temperatures using a thermal stylus or print head, or by heating while in contact with a heat-absorbing material.

Thermographic materials of the invention may also include a dye to facilitate direct development by exposure to laser radiation. Preferably, the dye is an infrared absorbing dye and the laser is a diode laser emitting in the infrared. Exposing radiation is converted to heat in the dye, thereby developing the image in the material.

Use as a Photomask

The thermographic and photothermographic materials of the present invention are sufficiently transmissive (including a transparent support) in the range of from about 350 to about 450 nm in non-imaged areas to allow their use in a process where there is a subsequent exposure of an ultraviolet or short wavelength visible radiation sensitive imageable medium. For example, imaging the photothermographic material and subsequent heat development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material (such as, a photopolymer, diazo material, photoresist, or photosensitive printing plate) that is sensitive to such imaging radiation. Exposing the imageable material to the imaging radiation through the visible image in the exposed and heat-developed photothermographic material provides an image in the imageable material. This process is particularly useful where the imageable medium comprises a printing plate and the photothermographic material serves as an imagesetting film.

Thermographic materials of this invention can be used in a similar fashion, as one skilled in the art would readily understand.

The following examples are provided to illustrate the practice of this invention, and are not intended to be limiting in any manner. Unless otherwise indicated, all materials are commercially available from one or more sources.

MATERIALS AND METHODS FOR THE EXAMPLES

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID™ A-21 or PARALOID A-21 is an acrylic copolymer available from Rohm and Haas (Philadelphia, Pa.).

BUTVAR® B-79 is a polyvinyl butyral resin available from Solutia, Inc. (St. Louis, Mo.).

CA 398-6 is a cellulose acetate resin available from Eastman Chemical Co. (Kingsport, Tenn.).

CAB 171-15S is a cellulose acetate butyrate resin available from Eastman Chemical Co. (Kingsport, Tenn.).

CBBA is chlorobenzoylbenzoic acid.

DESMODUR® N3300 is an aliphatic hexamethylene diisocyanate available from Bayer Chemicals (Pittsburgh, Pa.).

LOWINOX 221B446 is 2,2'-isobutylidene-bis(4,6-dimethylphenol) available from Great Lakes Chemical (West Lafayette, Ind.).

MEK is methyl ethyl ketone (or 2-butanone).

PERMANAX WSO (or NONOX) is 1,1-bis(2-hydroxy-3,5-dimethylphenyl)-3,5,5-trimethylhexane [CAS RN=7292-14-0] and is available from St-Jean PhotoChemicals, Inc. (Quebec, Canada).

"PHP" is pyridinium hydrobromide perbromide.

PIOLOFORM BS-18 and BL-16 are polyvinyl butyral resins available from Wacker Polymer Systems (Adrian, Mich.).

SYLOID 244 is a synthetic amorphous silica available from Grace Davison (Columbia, Md.).

VITEL 2200 and VITEL 5833B are polyester resins available from Bostik, Inc. (Middleton, Mass.).

2-(Tribromomethylsulfonyl)quinoline has the following structure:

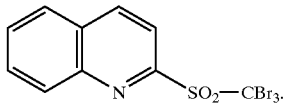

Preparation of Copolymers

Materials: Methanol was reagent grade. Monomers were purchased either from Aldrich Chemical Company (Milwaukee, Wis.), Scientific Polymer Products (Ontario, N.Y.), or TCI America (Portland, Oreg.). 2,2'-Azobisisobutyronitrile (AIBN) was obtained from Aldrich Chemical Co. and recrystallized twice from methanol.

Inhibitors were removed just before polymerization by passing the monomers through either a short column of neutral alumina (approximately 2 cm in diameter by 5 to 10 cm high), or through an inhibitor removal column from Scientific Polymer Products.

General Preparation: Copolymers useful in the practice of this invention were prepared by dissolving the monomers in appropriate mole ratios in reagent-grade methanol to make a 10 weight % solution. Initiator (2,2'-azobis-isobutyronitrile) was added such that its concentration was 0.5 weight % based on total weight of monomers. Nitrogen gas was bubbled through the solution for 30 minutes, and the solution was heated with stirring at 60° C. for 20 hr under a slight positive pressure of nitrogen. After cooling, the polymer solution was poured into a large excess of water. The precipitated polymer was filtered, washed, and dried in a vacuum oven at 40 to 50° C.

Molecular weight of the co-polymers was determined using gel permeation chromatography (GPC). Polystyrene of known molecular weight was used as a calibration standard.

Preparation of Polymer 2—Poly(2-hydroxyethyl methacrylate-co-methyl methacrylate) (50:50 mole ratio): A 2-liter 3-necked round-bottomed flask fitted with a mechanical stirrer, reflux condenser, and $N_2$-inlet tube was charged with 990 g of methanol, 63.4 g of 2-hydroxyethyl methacrylate, and 48.3 g of methyl methacrylate. The solution was sparged with $N_2$ for approx. 15 min, 0.6 g of 2,2'azobisisobutyronitrile was added, and the solution was stirred and sparged an additional 15 minutes. The reaction mixture was heated at 60° C. with stirring under a slight positive pressure of $N_2$ for 20 hr, cooled, and poured into a large excess of water. The precipitate was removed by filtration, washed with fresh water, and dried in a vacuum oven at 40–50 ° C.

Other copolymers described herein were prepared in a similar manner from appropriate starting materials.

EXAMPLE 1

Photothermographic materials were prepared using the following layer formulations and procedures.

Photothermographic Formulation:

This imaging layer formulation was prepared similarly to that described in U.S. Pat. No. 5,939,249 (Zou), incorporated herein by reference. The following TABLE I shows the components of this formulation, their formulation concentrations (% weight based on total formulation weight in methyl ethyl ketone), and dry coating coverage (g/m$^2$).

TABLE I

| Component | Formulation Concentration (% weight) | Dry Coating Coverage (g/m$^2$) |
|---|---|---|
| PIOLOFORM BS-18 | 2.85 | 1.54 |
| AgBr preformed grains | 0.34 | 0.184 |
| Behenic acid | 0.52 | 0.281 |
| Arachidic acid | 0.37 | 0.201 |
| Stearic acid | 0.26 | 0.139 |
| Ag behenate | 7.44 | 4.03 |
| Ag arachidate | 5.10 | 2.77 |
| Ag stearate | 0.82 | 0.443 |
| PHP | 0.08 | 0.043 |
| Zinc bromide | 0.08 | 0.042 |
| 2-Mercapto-5-methyl-benzimidazole | 0.05 | 0.027 |
| 2-(4-chlorobenzoyl)benzoic acid | 0.55 | 0.298 |
| Benzothiazolium, 3-ethyl-2-[[7-[[3-ethyl-5-(methylthio)-2(3H)-benzothiazolylidene]-methyl]-4,4a,5,6-tetrahydro-2(3H)-naphthalenylidene]methyl]-5-(methylthio)-, iodide | 0.002 | 0.001 |
| VITEL PE2200 | 0.08 | 0.045 |
| PIOLOFORM BL-16 | 13.6 | 7.40 |
| 2-Tribromomethyl-sulfonyl-quinoline | 0.43 | 0.233 |
| DESMODUR ® N3300 | 0.22 | 0.119 |
| LOWNINOX 221B46 | 3.15 | 1.71 |
| Tetrachlorophthalic acid | 0.12 | 0.065 |
| Phthalazine | 0.44 | 0.239 |
| 4-Methylphthalic acid | 0.20 | 0.108 |

Carrier Layer Formulation:

A carrier layer was coated underneath the photothermographic formulation out of MEK and comprised the components and amounts shown in TABLE II below.

TABLE II

| Component | Formulation Concentration (% weight) | Dry Coating Coverage (g/m$^2$) |
|---|---|---|
| VITEL 2200 | 0.274 | 0.012 |
| PIOLOFORM BL-16 | 6.57 | 0.296 |

Barrier Layer Formulation:

Once dried, the resulting imaging layer was overcoated with a barrier layer formulation. A Control A material was prepared by coating a topcoat formulation comprising solely cellulose acetate butyrate (CAB) as the binder material in MEK/MeOH 90:10. This material was considered a "Control" film because the topcoat layer is not a barrier layer within the scope of the present invention.

Photothermographic materials of the present invention were prepared similarly except that over the dried imaging layer was coated a solution containing a hydroxy containing polymer from a mixture of MEK/MeOH (60:40 or 90:10 v/v) to give a dry coverage of 2.75 g/m$^2$ of the overcoat layer. Examples also include blends of the hydroxy containing polymer with cellulose acetate butyrate (CAB). The hydroxy containing polymers used were:

Polymer 1: Poly(2-hydroxyethyl methacrylate-co-methyl methacrylate) (75:25 molar ratio), Polymer 2: Poly(2-hydroxyethyl methacrylate-co-methyl methacrylate) (50:50 molar ratio), Polymer 3: Poly(2-hydroxyethyl methacrylate-co-methyl methacrylate) (37.5:62.5 molar ratio), Polymer 4: Poly(2-hydroxyethyl methacrylate-co-methyl methacrylate) (15:85 molar ratio), Polymer 5: Poly(2-hydroxyethyl methacrylate-co-n-butyl methacrylate) (50:50 molar ratio), Polymer 6: Poly(2-hydroxyethyl acrylate-co-methyl methacrylate) (50:50 molar ratio), Polymer 7: Poly(2-hydroxyethyl methacrylate-co-isopropyl methacrylate) (50:50 molar ratio), Polymer 8: Poly(2-hydroxyethyl methacrylate-co-isopropyl methacrylate) (25:75 molar ratio), Polymer 9: Poly(2-hydroxyethyl methacrylate-co-n-propyl methacrylate) (25:75 molar ratio), Polymer 10: Poly(2-hydroxyethyl methacrylate-co-n-propyl methacrylate) (50:50 molar ratio), Polymer 11: Poly(2-hydroxypropyl methacrylate-co-methyl methacrylate) (50:50 molar ratio), Polymer 12: Poly(2-hydroxybutyl methacrylate-co-methyl methacrylate) (50:50 molar ratio), Polymer 13: Poly(2-hydroxyethyl methacrylate-co-cyclohexyl methacrylate) (50:50 molar ratio), The effectiveness of the various barrier layers to inhibit the diffusion of chemical components (such as fatty acids like behenic acid) from the imaging layer was evaluated as follows. A sample of the photothermographic material was placed between clean conventional (7.62 cm×2.54 cm) glass microscope slides. About 110 g of weight was evenly applied to the resulting laminate while it was heated at 120° C. for 30 minutes. The glass slide in contact with the photothermographic material topcoat was then analyzed for the relative amount of fatty acid transferred to it using Attenuated Total Reflectance Fourier Transform InfraRed Spectroscopy (ATR FTIR) and a conventional Bio-Rad FTS60 FTIR spectrometer fitted with a diamond ATR stage. At least two spectra of the glass slide from each photothermographic material sample were collected. The $CH_2$ stretching bands (2920 and 2850 cm$^{-1}$) and the $CH_3$ stretching band (2955 cm$^{-1}$) of the fatty acid were divided by the $SiO_2$ band (910 cm$^{-1}$) of the glass to provide a ratio after baseline correction. The relative amount of fatty acid transferred is directly related to the value of the ratio. That is, lower ratios mean lower fatty acid transfer and that the layer acts as a better barrier layer.

The effectiveness of the barrier layer compared to the CAB control layer is reported as % Reduction in Fatty Acid Transfer in Table III below. A larger % reduction indicates better barrier layer. The quality of the coating is also reported and can influence the effectiveness of the barrier layer. This can be altered by the selection of the solvent mixture used to coat the layer. It is one indication of the compatibility of the materials.

It is also apparent from the data that some of the "hydroxy" polymers useful in the present invention are best used alone in the barrier layer. That is, they are used without any additional polymer such as cellulose acetate butyrate. However, other "hydroxy" polymers provide optimal results when blended with additional polymers.

It was also observed that some of the barrier layer formulations used in the present invention provide optimal results when coated as a sole barrier layer in the photothermographic material. However, other barrier layer formulations provide optimal results when coated in combination with a protective overcoat layer formulation (for example comprising cellulose acetate butyrate) to provide two layers over the photothennographic emulsion layer(s).

All of these variables (including types and amounts of solvents) can be considered in routine experimentation to provide an optimal barrier layer formulation in the practice of this invention.

TABLE III

| Polymer | Polymer Glass Transition Temp. (° C.) [From DSC] | Barrier Layer: CAB/Polymer (weight ratio) | Coating Quality | % Reduction in Fatty Acid Transfer |
|---|---|---|---|---|
| Polymer 1 | 109 | 0/100 | Clear | >95 |
| Polymer 1 | 109 | 50/50 | Hazy | ** |
| Polymer 2 | 116 | 0/100 | Clear | >95 |
| Polymer 2 | 116 | 50/50 | Hazy | ** |
| Polymer 2 | 116 | 0/100 + 10% crosslinker* | Clear | >95 |
| Polymer 3 | 120 | 0/100 | Clear | ** |
| Polymer 3 | 120 | 50/50 | Hazy | 66 |
| Polymer 3 | 120 | 25/75 | Hazy | 80 |
| Polymer 4 | 122 | 0/100 | Clear | ** |
| Polymer 4 | 122 | 25/75 | Hazy | 80 |
| Polymer 4 | 122 | 75/25 | Hazy | 32 |
| Polymer 5 | 70 | 0/100 | Clear | 80 |
| Polymer 5 | 70 | 50/50 | Hazy | ** |
| Polymer 6 | 60 | 0/100 | Clear | 86 |
| Polymer 6 | 60 | 50/50 | Hazy | ** |
| Polymer 7 | 105 | 0/100 | Clear | 44 |
| Polymer 7 | 105 | 50/50 | Clear | 80 |
| Polymer 8 | 74 | 50/50 | Hazy | 77 |
| Polymer 8 | 74 | 75/25 | Clear | 71 |
| Polymer 9 | 42 | 50/50 | Hazy | 61 |

TABLE III-continued

| Polymer | Polymer Glass Transition Temp. (° C.) [From DSC] | Barrier Layer: CAB/Polymer (weight ratio) | Coating Quality | % Reduction in Fatty Acid Transfer |
|---|---|---|---|---|
| Polymer 9 | 42 | 75/25 | Clear | 77 |
| Polymer 10 | 45 | 0/100 | Clear | 79 |
| Polymer 10 | 45 | 50/50 | Hazy | 0 |
| Polymer 10 | 45 | 75/25 | Clear | 81 |
| Polymer 11 | 110 | 0/100 | Clear | 54 |
| Polymer 11 | 110 | 50/50 | Hazy | ** |
| Polymer 12 | 91 | 0/100 | Clear | 67 |
| Polymer 12 | 91 | 50/50 | Hazy | ** |
| Polymer 13 | 106 | 0/100 | Clear | Could not determine |
| Polymer 13 | 106 | 50/50 | Hazy | ** |

**Gross transfer, greater than control
*Crosslinker is Desmodur N3300, a polyisocyanate from Bayer

EXAMPLES 2–4

Several "hydroxy polymers" were evaluated alone or in mixtures with cellulose acetate butyrate (CAB 171-15S) in barrier layers according to the present invention. In Example 2, the barrier layer was a surface barrier layer over the imaging layer. In Example 3, the barrier layer was coated over the imaging layer simultaneously with an outermost protective layer comprising CAB. In Example, 4, the barrier layer was coated over the imaging layer, dried, and then overcoated with a protective layer comprising CAB. As in Example 1, a Control B material was prepared by coating directly over the imaging layer, an overcoat formulation comprising solely cellulose acetate butyrate (CAB) as the binder material in MEK. This material was considered a "Control" film because the CAB overcoat layer is not a barrier layer within the scope of the present invention.

The photothermographic materials were prepared as in Example 1, with the following modifications:

The imaging formulation did not contain VITEL PE2200.

The carrier layer contained Pioloform BN-18 and VITEL 5833B, and was coated out of MEK to provide a dry coverage of 0.79 g/m$^2$ and 0.34 g/m$^2$, respectively.

The barrier formulations contained only the polymer and solvent shown in Table V, and were coated to give a dry coverage of approximately 2.5 g/m$^2$.

The CAB overcoat formulation used in Examples 3 and 4 and for Control B contained CAB and MEK, and was coated to give a dry coverage of approximately 2.5 g/m$^2$.

The various barrier layer formulations contained the film-forming "hydroxy polymers" described as follows:

Polymer 2: poly(2-hydroxyethyl methacrylate-co-methyl ethacrylate) (50:50 molar ratio), Polymer 14: poly(2-hydroxyethyl methacrylate-co-isodecyl methacrylate) (50:50 molar ratio), Polymer 15: poly(2-hydroxyethyl methacrylate-co-isobutyl methacrylate) (50:50 molar ratio), Polymer 16: poly(2-hydroxyethyl methacrylate-co-isobutyl methacrylate) (75:25 molar ratio), Polymer 17: poly(2-hydroxyethyl methacrylate-co-3-chloro-2-hydroxypropyl methacrylate) (50:50 molar ratio), Polymer 7: poly(2-hydroxyethyl methacrylate-co-isopropyl methacrylate) (50:50 molar ratio), Polymer 18: poly(2-hydroxyethyl methacrylate-co-ethyl methacrylate) (50:50 molar ratio), Polymer 19: poly(hydroxyethyl methacrylate), and Polymer 20: poly(hydroxyethyl methacrylate-co-t-butyl methacrylate) (50:50 molar ratio).

The various photothermographic materials were evaluated for $D_{min}$ and reduction in fatty acid emission (diffusion) from the imaging layer during heat development.

In these examples, the reduction in fatty acid emissions was evaluated in a manner different from that described in Example 1. A receptor sheet of 1 mil (25.4 $\mu$m) polyethylene terephthalate (PET) coated with CA-398-6 and SYLOID 244 was placed over the surface barrier layer, and the materials were heat-developed at 122° C. for 15 seconds using a conventional DRYVIEW™ 8700 Thermal Processor. The receptor sheet was then removed and any chemicals that were transferred to it from the photothermographic material were extracted and analyzed by GC/MS.

The % reduction in fatty acids transferred compared to Control B were then calculated with the larger % number indicating better barrier properties. Higher reductions of fatty acid emission and lower $D_{min}$ are desired.

The results are shown in TABLE IV below. It is apparent that not every "hydroxy polymer" provided the desired fatty acid emission control and low $D_{min}$ as a barrier layer in every situation. For exarnple, some "hydroxy polymers" performed best when used in a barrier layer under a protective overcoat while others performed best in the outermost surface layer. Still other "hydroxy polymers" performed best when used alone in the barrier layer while others performed best when used in a mixture with CAB. Still again, some barrier layers provided excellent "barrier" properties while others were better at keeping $D_{min}$ low. Thus, a skilled artisan is provided teaching in this application sufficient to design an optimum barrier layer formulation to achieve all desired physical and sensitometric properties using various film-forming polymers, coating solvents, and locations in the thermographic or photothermographic materials.

It should be noted that when the same polymer was used as a barrier layer, the amount of fatty acid emissions found in Example 1 differed from that in found in Examples 2–4. This is due to the different tests used to determine fatty acid emission. However, both tests indicated significant reduction in fatty acid emission.

TABLE IV

| "Hydroxy Polymer" | Barrier Layer Solvent | Barrier Layer: CAB/Polymer (weight ratio) | Example 2 Dmin | Example 2 % Reduction in Fatty Acid Transfer | Example 3 Dmin | Example 3 % Reduction in Fatty Acid Transfer | Example 4 Dmin | Example 4 % Reduction in Fatty Acid Transfer |
|---|---|---|---|---|---|---|---|---|
| 2 | MEK | 0/100 | High | 87–96% | Low | 0 | High | 67–89% |
| 2 | MeOH | 0/100 | — | — | — | — | Low | 97% |
| 14 | MEK | 0/100 | Low | 23% | Low | 11–45% | Low | 21–32% |
| 15 | MEK | 0/100 | Low | 0 | Low | 12–34% | Low | 21–27% |
| 15 | MEK | 50/50 | Low | 18% | — | — | — | — |
| 15 | MEK | 75/25 | Low | 28% | — | — | — | — |
| 16 | MEK | 0/100 | — | — | Low | 0 | Low | 29–40% |
| 16 | MEK | 50/50 | Low | 38% | — | — | — | — |
| 16 | MEK | 75/25 | Low | 26% | — | — | — | — |
| 17 | MEK | 0/100 | High | 95% | Low | 0 | High | 0 |
| 7 | MEK | 0/100 | — | — | Low | 0–16% | Low | 0–10% |
| 7 | MEK | 50/50 | Low | 28% | — | — | — | — |
| 7 | MEK | 75/25 | Low | 21% | — | — | — | — |
| 18 | MEK | 0/100 | — | — | Low | 0–7% | Low | 0–5% |
| 18 | MEK | 75/25 | Low | 21% | — | — | — | — |
| 18 | MEK | 40/60 | Low | 34% | — | — | — | — |
| 19** | MEK/MeOH | 0/100 | — | — | — | — | High | 100% |
| 19** | MeOH | 0/100 | Low | 100% | — | — | Low | 100% |
| 20 | MEK | 0/100 | — | — | Low | 0 | Low | 15% |
| 20 | MEK | 50/50 | Low | 32% | — | — | — | — |
| 20 | MEK | 75/25 | Low | 24–46% | — | — | — | — |

**Not soluble in MEK
— = not available

The invention has been described in detail with particular reference to certain preferred embodiments thereof, but it will be understood that variations and modifications can be effected within the spirit and scope of the invention.

We claim:

1. A thermally developable material comprising a support having thereon:

a) one or more thermally developable imaging layers comprising a binder and in reactive association, a non-photosensitive source of reducible silver ions and a reducing composition for said non-photosensitive source reducible silver ions, and b) a barrier layer that is on the same side of but farther from said support than said one or more imaging layers, said barrier layer comprising a film-forming acrylic or methacrylic acid ester or amide polymer having a molecular weight of at least 8000 g/mole and comprising recurring units derived from one or more ethylenically unsaturated polymerizable acrylic or methacrylic acid ester or amide monomers, wherein from about 15 to 100 mole % of the recurring units in said polymer are derived from such monomers that have hydroxy functionality.

2. The thermally developable material of claim 1 that further comprises a protective layer that is disposed between said barrier layer and said one or more imaging layers.

3. The thermally developable material of claim 1 wherein said barrier layer is the outermost surface layer.

4. The thermally developable material of claim 1 further comprising an outermost protective overcoat layer, and said barrier layer is disposed between said outermost protective overcoat layer and said one or more imaging layers.

5. The thermally developable material of claim 1 wherein said non-photosensitive source of reducible silver ions is a silver fatty acid carboxylate having 10 to 30 carbon atoms in the fatty acid or a mixture of said silver carboxylates.

6. The thermally developable material of claim 1 further comprising a co-developer.

7. The thermally developable material of claim 6 wherein said co-developer is selected from the group consisting of trityl hydrazides, formyl phenyl hydrazides, 3-heteroaromatic-substituted acrylonitriles, 2-substituted malondialdehyde compounds, acrylonitrile compounds, 4-substituted isoxazoles, 2,5-dioxo-cyclopentane carboxaldehydes, 5-(hydroxymethylene)-2,2-dimethyl,-1,3-dioxane-4,6-diones, 5-(hydroxymethylene)-1,3-dialkylbarbituric acids, and 2-(ethoxymethylene)-1H-indene-1,3(2H)-diones.

8. The thermally developable material of claim 6 further comprising a contrast enhancing agent.

9. The photothermographic material of claim 8 wherein said contrast enhancing agent is selected from the group consisting of hydroxylamines, alkanolamines, ammonium phthalamate compounds, hydroxamic acid compounds, N-acylhydrazine compounds, and hydrogen atom donor compounds.

10. The thermally developable material of claim 1 that is a photothermographic material further comprising a photocatalyst.

11. The thermally developable material of claim 10 wherein said photocatalyst is a silver halide or mixture of silver halides.

12. The thermally developable material of claim 1 wherein said binder is a hydrophobic binder, and said film-forming polymer having hydroxy functionality is more soluble in polar organic solvents than in water.

13. The thermally developable material of claim 12 wherein said film-forming polymer having hydroxy functionality comprises from about 20 to 75 mole % of acrylic or methacrylic acid ester or amide recurring units that include one or more hydroxy groups.

14. The thermally developable material of claim 1 wherein said film-forming acrylate or methacrylate polymer having hydroxy functionality is a represented by Formula I:

$$—(A)_m—(B)_n— \quad \text{I}$$

wherein A represents recurring units derived from one or more ethylenically unsaturated polymerizable acrylic or methacrylic acid ester or amide monomers comprising one or more pendant hydroxy groups, B represents recurring units derived from one or more ethylenically unsaturated polymerizable acrylic or methacrylic acid ester or amide monomers other than those represented by A, m is from about 15 to 100 mole %, and n is from 0 to about 85 mole %.

15. The thermally developable material of claim 14 wherein A represents recurring units derived from one or more of 2-hydroxyethyl methacrylate, 2-hydroxyethyl acrylate, 3-chloro-2-hydroxypropyl methacrylate, 2,3-dihydroxypropyl methacrylate, polypropyleneglycol methacrylate, 2-hydroxypropyl methacrylate, 3-hydroxypropyl methacrylate, 2-hydroxybutyl methacrylate, 2-hydroxyethyl methacrylamide, and 1,3-dihydroxy-2-hydroxymethyl-2-propyl methacrylamide, 3-chloro-2-hydroxypropyl acrylate, 2,3-dihydroxypropyl acrylate, polypropyleneglycol acrylate, 2-hydroxypropyl acrylate, 3-hydroxypropyl acrylate, 2-hydroxybutyl acrylate, 2-hydroxyethyl acrylamide, and 1,3-dihydroxy-2-hydroxymethyl-2-propyl acrylamide, and B represents recurring units derived from one or more of methyl acrylate, ethyl acrylate, iso-propyl acrylate, methyl methacrylate, ethyl methacrylate, iso-propyl methacrylate, n-butyl acrylate, t-butyl methacrylate, iso-decyl methacrylate, iso-butyl methacrylate, cyclohexyl methacrylate, cyclohexyl acrylate, lauryl methacrylate, methyl acrylamide, ethyl methacrylamide, and allyl methacrylate.

16. The thermally developable material of claim 14 wherein m is from about 30 to about 75 mole %, and n is from about 25 to about 70 mole %.

17. The thermally developable material of claim 15 wherein A represents recurring units derived from 2-hydroxyethyl methacrylate, 2-hydroxyethyl acrylate, or both, and B represents recurring units derived from methyl methacrylate, iso-propyl methacrylate, iso-butyl methacrylate, or mixtures thereof.

18. The thermally developable material of claim 1 wherein said barrier layer further comprises one or more additional film-forming polymers.

19. The thermally developable material of claim 18 wherein said one or more additional film-forming polymers are cellulosic materials, polyacrylates, polymethacrylates, polyesters, or polyurethanes.

20. The thermally developable material of claim 19 wherein said barrier layer comprises one or more of cellulose acetate butyrate, cellulose acetate, or cellulose acetate propionate.

21. The thermally developable material of claim 1 that is a photothermographic material that is sensitive to radiation of from about 300 to about 850 nm.

22. The thermally developable material of claim 1 wherein said barrier layer is capable of retarding the diffusion of or reacting with fatty carboxylic acids.

23. The thermally developable material of claim 22 wherein said barrier layer is capable of retarding the diffusion of or is reactive with behenic acid.

24. A black-and-white photothermographic material comprising a support having on one side thereof:

a) one or more thermally developable imaging layers comprising a binder and in reactive association, a photosensitive silver halide, one or more non-photosensitive silver carboxylates composed of fatty carboxylic acids having 10 to 30 carbon atoms, or a mixture of said silver carboxylates, including at least silver behenate, and a hindered phenol reducing agent for said silver fatty acid carboxylates, b) a barrier layer that is farther from said support than said one or more imaging layers, said barrier layer comprising one or more film-forming acrylate or methacrylate polymers, each having a molecular weight of at least 8000 g/mole and being represented by Formula I:

$$-(A)_m-(B)_n- \qquad \text{I}$$

wherein A represents recurring units derived from one or more ethylenically unsaturated polymerizable acrylic or methacrylic acid ester or amide monomers comprising one or more hydroxy groups, B represents recurring units derived from one or more ethylenically unsaturated polymerizable acrylic or methacrylic acid ester or amide other than those represented by A, m is from about 15 to 100 mole %, and n is from 0 to about 85 mole %, said barrier layer being capable of retarding diffusion of or reacting with said fatty carboxylic acids, and said film-forming acrylate or methacrylate polymer being present in said barrier layer in an amount of from about 25 to 100 weight %, and said one or more additional film-forming polymers being present in said barrier layer in an amount of from 0 to about 75 weight %, based on the total dry weight of said barrier layer, said one or more additional film-forming polymers being cellulosic materials, polyacrylates, polymethacrylates, polyesters or polyurethanes.

25. The photothermographic material of claim 24 wherein said film-forming acrylate or methacrylate polymer of Formula I is:

poly(2-hydroxyethyl methacrylate-co-methyl methacrylate), poly(2-hydroxyethyl methacrylate-co-iso-decyl methacrylate), poly(2-hydroxyethyl methacrylate-co-iso-butyl methacrylate), poly(2-hydroxyethyl methacrylate-co-ethyl methacrylate-co-methyl methacrylate), poly(2-hydroxyethyl acrylate-co-methyl methacrylate), poly(2-hydroxyethyl methacrylate-co-3-chloro-2-hydroxypropyl methacrylate), poly(2-hydroxyethyl methacrylate-co-iso-propyl methacrylate), poly(2-hydroxyethyl methacrylate-co-ethyl methacrylate), poly(2-hydroxyethyl methacrylate), poly(2-hydroxyethyl methacrylate-co-n-butyl methacrylate), poly(2-hydroxyethyl methacrylate-co-n-propyl methacrylate), poly(2-hydroxypropyl methacrylate-co-methyl methacrylate), poly(2-hydroxybutyl methacrylate-co-methyl methacrylate, poly(2-hydroxyethyl methacrylate-co-cyclohexyl methacrylate), or poly(2-hydroxyethyl methacrylate-co-t-butyl methacrylate).

26. The photothermographic material of claim 25 wherein said film-forming acrylate or methacrylate polymer is poly (2-hydroxyethyl methacrylate-co-methyl methacrylate), poly(2-hydroxyethyl methacrylate-co-iso-butyl methacrylate), or poly(2-hydroxyethyl methacrylate-co-isopropyl methacrylate).

27. The photothermographic material of claim 24 wherein said additional film-forming polymer is cellulose acetate butyrate.

28. The photothermographic material of claim 24 further comprising a toner.

29. The photothermographic material of claim 28 further comprising phthalazine or a derivative thereof as a toner.

30. The photothermographic material of claim 24 further comprising a co-developer, a contrast enhancing agent, or both.

31. The photothermographic material of claim 24 further comprising a polyhalo antifoggant having a $—SO_2C(X')_3$ group wherein X' represents the same or different halogen atoms.

32. A photothermographic material comprising a support having thereon:

a) one or more thermally developable imaging layers comprising a binder and in reactive association, a photocatalyst, a non-photosensitive source of reducible silver ions, and a reducing composition for said non-photosensitive source reducible silver ions, and b) a barrier layer that is on the same side of but farther from said support than said one or more imaging layer, said barrier layer comprising a film-forming acrylic or methacrylic acid ester or amide polymer having a molecular weight of at least 8000 g/mole and comprising recurring units derived from one or more ethylenically unsaturated polymerizable acrylic or methacrylic acid ester or amide monomers, wherein from about 15 to 100 mole % of the recurring units in said polymer are derived from such monomers that have hydroxy functionality.

33. A method of forming a visible image comprising:

A) imagewise exposing the photothermographic material of claim 32 to electromagnetic radiation to form a latent image, and B) simultaneously or sequentially, heating said exposed photothermographic material to develop said latent image into a visible image.

34. The method of claim 33 wherein said photothermographic material has a transparent support and said method further comprises:

C) positioning said exposed and heat-developed photothermographic material between a source of imaging radiation and an imageable material that is sensitive to said imaging radiation, and D) exposing said imageable material to said imaging radiation through the visible image in said exposed and heat-developed photothermographic material to provide an image in said imageable material.

35. A method of preparing a photothermographic material comprising:

A) applying to a support a photothermographic imaging formulation comprising a binder, a silver halide, a non-photosensitive source of reducible silver ions, and a reducing composition for said non-photosensitive source reducible silver ions, and B) simultaneously or subsequently, applying a barrier layer formulation over said photothermographic imaging formulation, said barrier layer formulation comprising a solvent, and a film-forming acrylic or methacrylic acid ester or amide polymer having a molecular weight of at least 8000 g/mole and comprising recurring units derived from one or more ethylenically unsaturated polymerizable acrylic or methacrylic acid ester or amide monomers, wherein from about 15 to 100 mole % of the recurring units in said polymer are derived from such monomers that have hydroxy functionality.

36. The method of claim 35 wherein said barrier layer formulation further comprises one or more additional film-forming polymers that are cellulosic materials, polyacrylates, polymethacrylates, polyesters, or polyurethanes.

37. The method of claim 36 further comprising:

C) simultaneously or subsequently, applying a protective overcoat layer formulation over said barrier layer formulation, said protective overcoat layer formulation comprising an organic solvent and one or more additional film-forming polymers that are cellulosic materials, polyacrylates, polymethacrylates, polyesters, or polyurethanes.

38. The method of claim 35 further comprising:

C) simultaneously or subsequently, applying a protective overcoat layer formulation over said barrier layer formulation, said protective overcoat layer formulation comprising an organic solvent and one or more additional film-forming polymers that are cellulosic materials, polyacrylates, polymethacrylates, polyesters, or polyurethanes.

* * * * *